US010221645B2

(12) United States Patent
Elliott

(10) Patent No.: US 10,221,645 B2
(45) Date of Patent: Mar. 5, 2019

(54) HIGH-INTEGRITY PRESSURE PROTECTION SYSTEM CHRISTMAS TREE

(71) Applicant: Cameron International Corporation, Houston, TX (US)

(72) Inventor: Declan Elliott, Newtownforbes (IE)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/620,958

(22) Filed: Jun. 13, 2017

(65) Prior Publication Data

US 2017/0362909 A1 Dec. 21, 2017

Related U.S. Application Data

(60) Provisional application No. 62/350,711, filed on Jun. 15, 2016.

(51) Int. Cl.

| | |
|---|---|
| ***E21B 33/037*** | (2006.01) |
| ***E21B 33/035*** | (2006.01) |
| ***E21B 33/038*** | (2006.01) |
| ***E21B 43/013*** | (2006.01) |
| ***E21B 33/03*** | (2006.01) |
| ***E21B 43/00*** | (2006.01) |
| *E21B 33/128* | (2006.01) |
| *E21B 34/04* | (2006.01) |
| *E21B 43/01* | (2006.01) |

(52) U.S. Cl.

CPC ..... *E21B 33/037* (2013.01); *E21B 33/03* (2013.01); *E21B 33/038* (2013.01); *E21B 33/0355* (2013.01); *E21B 43/00* (2013.01); *E21B 43/013* (2013.01); *E21B 33/1285* (2013.01); *E21B 34/04* (2013.01); *E21B 2043/0115* (2013.01)

(58) Field of Classification Search

CPC ..... E21B 33/0355

See application file for complete search history.

(56) References Cited

U.S. PATENT DOCUMENTS 8,051,875 B2 11/2011 Edwards
8,161,993 B2 * 4/2012 Ratcliffe ..... E21B 41/0007 137/12

(Continued)

OTHER PUBLICATIONS

"The SSS Product Line," brochure, 62 pages, published by Cameron International Corporation, Houston, Texas, dated 2008.

(Continued)

*Primary Examiner* — Matthew R Buck
*Assistant Examiner* — Aaron L Lembo
(74) *Attorney, Agent, or Firm* — Eubanks PLLC

(57) ABSTRACT

A high-integrity pressure protection system Christmas tree is provided. In one embodiment, an apparatus includes a Christmas tree, a choke coupled to receive fluid from the Christmas tree, and a high-integrity pressure protection system. The high-integrity pressure protection system includes pressure sensors downstream of the choke, valves upstream of the choke, and a logic solver connected to control operation of the valves of the high-integrity pressure protection system that are upstream of the choke. Further, the valves of the high-integrity pressure protection system that are upstream of the choke include at least two valves of the Christmas tree. Additional systems, devices, and methods are also disclosed.

18 Claims, 3 Drawing Sheets

(56) References Cited

U.S. PATENT DOCUMENTS

| | | | | |
|---|---|---|---|---|
| 8,616,230 | B2 | 12/2013 | Studer | |
| 8,978,750 | B2 * | 3/2015 | Noske | E21B 34/08 166/332.8 |
| 9,151,137 | B2 | 10/2015 | Daigle | |
| 9,163,481 | B2 * | 10/2015 | Noske | E21B 23/02 |
| 9,222,555 | B2 | 12/2015 | Morin et al. | |
| 9,822,598 | B2 * | 11/2017 | Miller | E21B 31/107 |
| 9,896,911 | B2 * | 2/2018 | Maher | E21B 41/0007 |
| 2005/0205262 | A1 * | 9/2005 | Reimert | E21B 33/035 166/348 |
| 2007/0095401 | A1 * | 5/2007 | Webster | F16K 17/10 137/488 |
| 2008/0000529 | A1 * | 1/2008 | Lawrence Edwards | F16K 17/02 137/455 |
| 2010/0071775 | A1 | 3/2010 | Ratcliffe | |
| 2011/0056566 | A1 * | 3/2011 | Studer | F16K 17/406 137/1 |
| 2011/0240157 | A1 * | 10/2011 | Jones | F16K 17/02 137/613 |
| 2011/0259596 | A1 * | 10/2011 | Daigle | E21B 34/04 166/344 |
| 2012/0221295 | A2 | 8/2012 | Flanders | |
| 2015/0027730 | A1 * | 1/2015 | Hall | E21B 34/02 166/379 |
| 2016/0076334 | A1 * | 3/2016 | Maher | E21B 34/04 137/12 |
| 2017/0211355 | A1 * | 7/2017 | Maher | E21B 41/0007 |
| 2017/0329356 | A1 * | 11/2017 | McKeon | G05D 16/2013 |
| 2018/0010711 | A1 * | 1/2018 | Jansen | F16K 1/16 |
| 2018/0058165 | A1 * | 3/2018 | Maher | E21B 33/0355 |
| 2018/0058166 | A1 * | 3/2018 | Maher | E21B 33/0355 |
| 2018/0058620 | A1 * | 3/2018 | Critsinelis | F16L 55/055 |

OTHER PUBLICATIONS

"High Integrity Pressure Protection System (HIPPS)," brochure, 6 pages, published by Cameron International Corporation, Houston, Texas, dated 2016.

* cited by examiner

HIGH-INTEGRITY PRESSURE PROTECTION SYSTEM CHRISTMAS TREE

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

Wellhead assembly components may be rated for relatively high pressures, such as pressures that may be expected during drilling or production. In a production system, fluid produced from a well may be routed through a choke to throttle the pressure from a higher pressure to a lower pressure. This allows other components downstream of the choke to be rated for lower pressures than those for which the wellhead assembly components are rated.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to a high-integrity pressure protection system (HIPPS) Christmas tree. For example, in certain embodiments a HIPPS includes pressure sensors for monitoring pressure downstream of a choke and incorporates valves of a Christmas tree as the final elements of the HIPPS for stopping flow in the event of over-pressurization. The HIPPS (and its components) can take any suitable form, and may be an electronic system or a hydraulic system.

Various refinements of the features noted above may exist in relation to various aspects of the present embodiments. Further features may also be incorporated in these various aspects. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
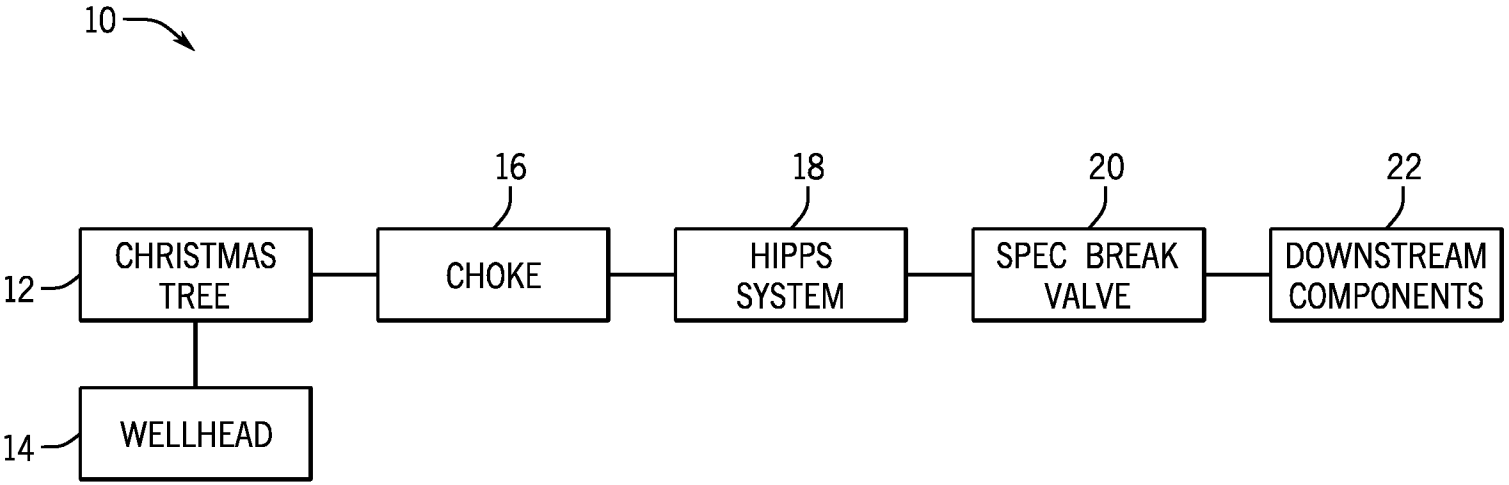
FIG. 1 generally depicts a production system including a high-integrity pressure protection system in accordance with an embodiment of the present disclosure.

Turning now to the present figures, an example of a production system 10 is provided in FIG. 1 in accordance with one embodiment. The production system 10 facilitates extraction of natural resources, such as oil or natural gas, from a well via a Christmas tree 12 coupled to a wellhead 14. Among other components, the Christmas tree 12 includes valves for controlling flow of production fluids or other fluids through the Christmas tree 12 out of, or into, the well. In at least some instances, the production system 10 is an onshore production system having a surface Christmas tree 12 for a surface well. But it will be appreciated that natural resources may be extracted from other wells, such as platform or subsea wells, and that a production system 10 in accordance with the present techniques can be used with such other wells. Accordingly, it is noted that the Christmas tree 12 can be a subsea Christmas tree in other embodiments.

Produced fluids can be routed from the Christmas tree 12 through a choke 16 and a flowline to downstream components 22. The downstream components 22 can include any of a variety of objects and systems, such as pipelines, gas plants, gas-oil separation plants, offshore platforms, compressor stations, storage facilities, chemical plants, and floating production storage and offloading (FPSO) vessels, to name just some examples. In at least some surface production system embodiments, the choke 16 is installed in a production wing of the Christmas tree, though the choke 16 could be positioned elsewhere within the system 10.

During production, the choke 16 is used to control flow and pressure of produced fluids from the Christmas tree 12. Wellheads and Christmas trees are typically rated for use with high-pressure fluids. In contrast, rather than constructing downstream components 22 to be rated for high pressures like wellheads and Christmas trees, many downstream components 22 may be intended for use at pressures lower than those reasonably expected at a wellhead. The choke 16 can be used to reduce the pressure of fluids flowing out of the Christmas tree 12 (e.g., through a production flowline) to a level suitable for the downstream components 22. As also depicted in FIG. 1, the system 10 includes a spec break valve 20 used between pipes of a fluid conduit having different specifications (e.g., pressure ratings). For example, the portion of the fluid conduit upstream of the valve 20 may have higher pressure rating than the portion of the fluid conduit downstream of the valve 20.

The depicted production system 10 also includes a high-integrity pressure protection system (HIPPS) 18. As will be appreciated, a HIPPS is a safety instrumented system designed to prevent over-pressurization of pipelines, facilities, and other components downstream of the HIPPS. In the presently depicted embodiment, the HIPPS 18 detects high-pressure conditions downstream of the choke 16 and closes isolation valves to protect lower-rated downstream components 22.

Figure 2:
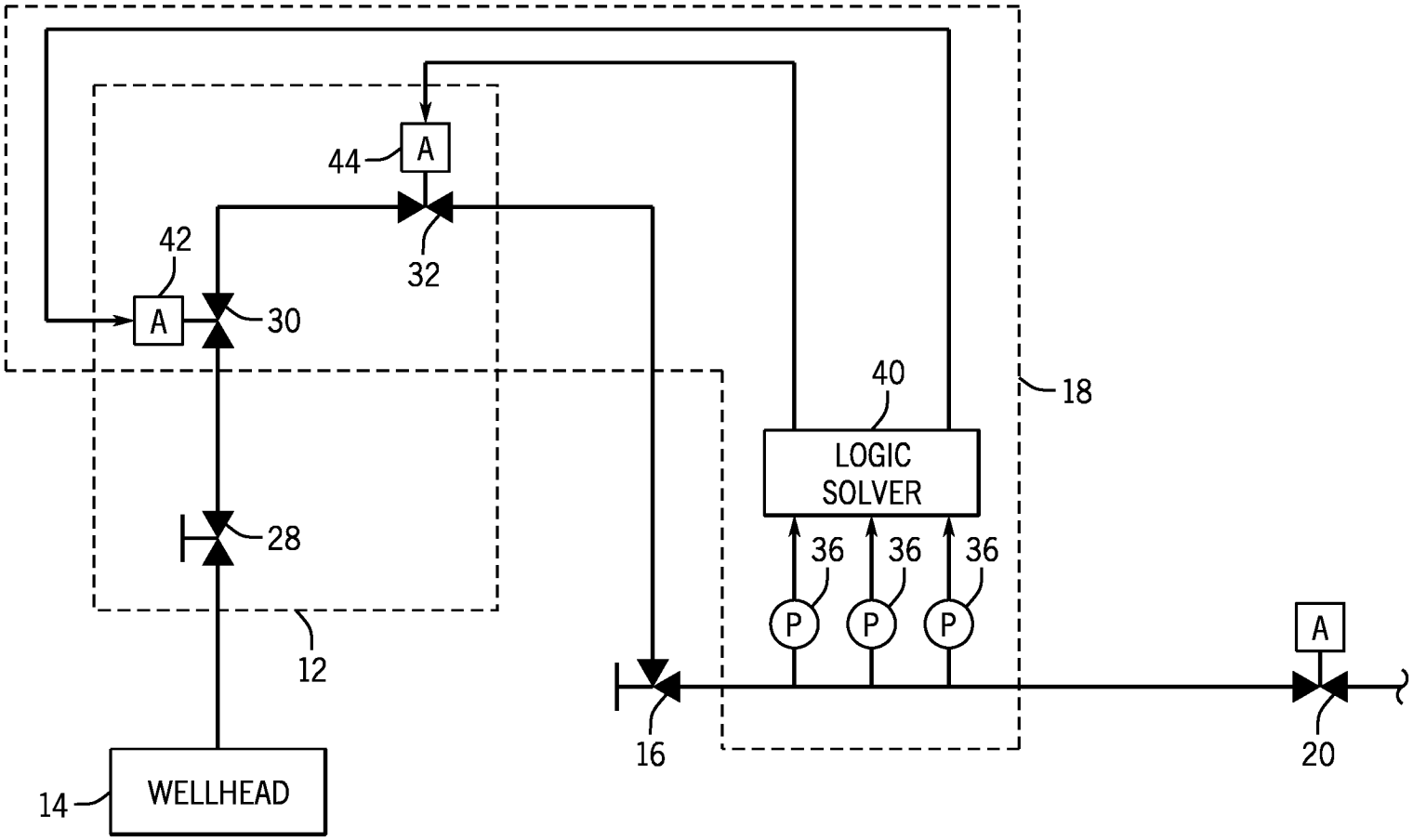
FIG. 2 is a schematic of the production system of FIG. 1, which shows the use of a Christmas tree as part of the high-integrity pressure protection system in accordance with one embodiment.

In some instances, a HIPPS is a standalone, self-contained, modular unit including initiators (e.g., pressure sensors) and final elements (e.g., shutdown valves) that are closed in response to detected over-pressure conditions (i.e., pressure measured by the pressure sensors that exceeds a given threshold level). But in at least some embodiments of the present disclosure, the HIPPS 18 is a distributed system, in which its initiators are provided at a location downstream from the choke 16, while its final elements are provided at a different location upstream from the choke 16. One example of such a distributed HIPPS 18 is generally depicted in FIG. 2 and is described in greater detail below. In at least some embodiments, the HIPPS 18 is compliant with IEC 61508 and 61511 standards (promulgated by the International Electrotechnical Commission) and has a certified safety integrity level (SIL) of three or four.

The Christmas tree 12 is shown in FIG. 2 as including a lower master valve 28, an upper master valve 30, and production wing valve 32. The valves 28, 30, and 32 can be provided as gate valves or any other suitable valves. Further, the Christmas tree 12 may include additional valves not depicted in this schematic. When valves 28, 30, and 32 are open, fluid produced through the wellhead 14 flows through the Christmas tree 12 to the choke 16. The produced fluid would typically experience a pressure drop as it flows through the choke 16 and, during intended operation, the resulting pressure downstream of the choke 16 would be at a pressure level suitable for the downstream components 22.

The distributed HIPPS 18 of FIG. 2 includes initiators in the form of pressure sensors 36 for monitoring pressure in a fluid conduit downstream of the choke 16. In at least some embodiments, the distributed HIPPS 18 includes final elements located upstream of the choke 16, apart from the pressure sensors 36. More specifically, in certain embodiments valves of the Christmas tree 12 are used as the final elements of the distributed HIPPS 18, rather than adding additional valves dedicated to the HIPPS 18. For example, in FIG. 2 the upper master valve 30 and the production wing valve 32 are incorporated as the final elements of the HIPPS 18. In other instances, different valves of the Christmas tree 12 (e.g., other production-oriented valves that are already part of the Christmas tree) may be used as the final elements of the HIPPS 18.

Pressure sensors 36 provide input to a logic solver 40 (which may also be referred to herein as a controller) that outputs a control signal, based on the received input from the sensors 36, to operate the valves 30 and 32 via actuators 42 and 44. In at least one embodiment, the logic solver 40 uses two-out-of-three logic to determine whether at least two of pressure sensors 36 are detecting an over-pressure condition and, if so, to output a control signal to close one or both valves 30 and 32. In at least some embodiments the valves 30 and 32 operated with the actuators 42 and 44 are fail-closed, solenoid valves, but the valves 30 and 32 and the actuators 42 and 44 can take any suitable form in various embodiments. Although the logic solver 40 is operable to close each of valves 30 and 32, in practice the logic solver 40 could cause either or both of the valves 30 and 32 to close in response to a determination that pressure detected by the sensors 36 has exceeded a threshold level (e.g., a level equal to or within ten percent of the pressure rating of a downstream component 22).

Figure 3:
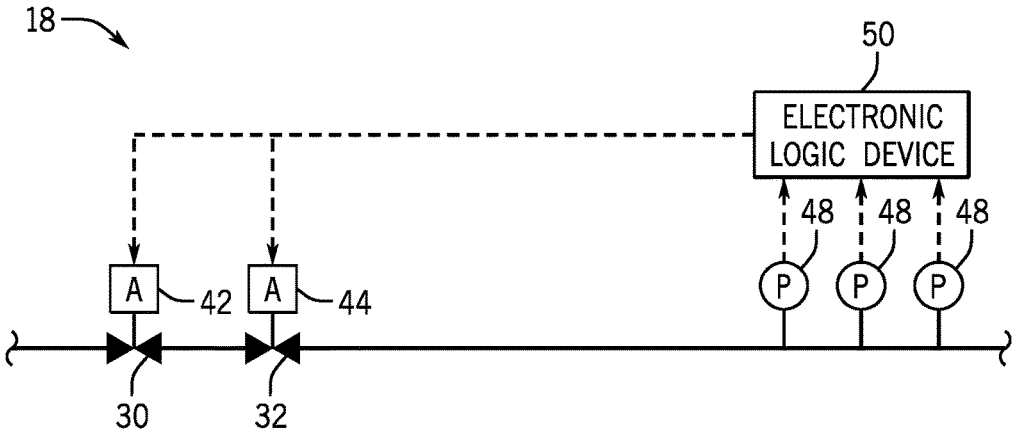
FIG. 3 is a schematic depicting the high-integrity pressure protection system as an electronic high-integrity pressure protection system in accordance with one embodiment.

The logic solver 40 can also take any suitable form. In certain embodiments, including the one depicted in FIG. 3, the HIPPS 18 is an electronic HIPPS with the logic solver 40 provided as an electronic logic device 50 (e.g., a programmable logic controller). This electronic logic device 50 receives input from pressure sensors (here depicted as three pressure transducers 48) and sends control signals to actuators 42 and 44 to close the valves 30 and 32 in the event that the pressure detected with the pressure transducers 48 exceeds a threshold level (e.g., a level equal to or within ten percent of the pressure rating of a downstream component 22).

Figure 4:
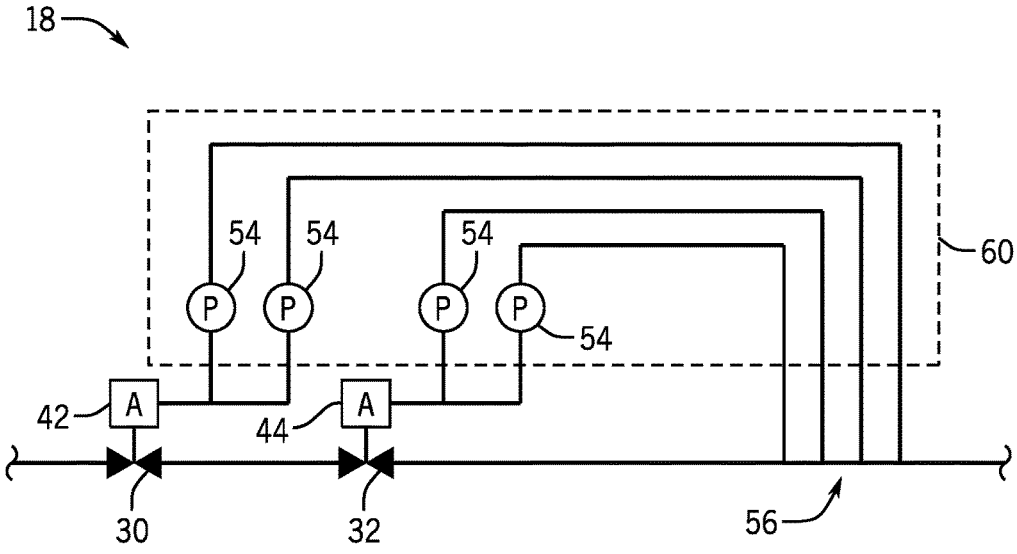
FIG. 4 is a schematic depicting the high-integrity pressure protection system as a hydraulic high-integrity pressure protection system in accordance with one embodiment.

In some other embodiments, including that generally shown in FIG. 4, the HIPPS 18 is a hydraulic HIPPS. The depicted hydraulic HIPPS 18 includes pressure sensors 54 connected to the fluid conduit via pressure taps 56. In this case, the pressure sensors 54 operate as the initiators of the HIPPS 18. Further, the parallel arrangement of the pressure sensors 54 and the taps 56, along with the actuators 42 and 44 (which can function as OR logic devices such that over-pressurization by either of the two pressure sensors 54 connected to a given actuator causes the actuator to close its valve), operates as a hydraulic logic solver 60.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a Christmas tree;

a choke coupled to receive fluid from the Christmas tree; and a high-integrity pressure protection system including pressure sensors downstream of the choke, valves upstream of the choke, and a logic solver connected to control operation of the valves of the high-integrity pressure protection system that are upstream of the choke, wherein the valves of the high-integrity pressure protection system that are upstream of the choke include at least two valves of the Christmas tree.

2. The apparatus of claim 1, wherein the at least two valves of the Christmas tree and of the high-integrity pressure protection system include a wing valve of the Christmas tree and a master valve of the Christmas tree.

3. The apparatus of claim 1, wherein the pressure sensors of the high-integrity pressure protection system include three pressure sensors.

4. The apparatus of claim 3, wherein the logic solver is configured to command one or more of the valves of the at least two valves of the Christmas tree to close in response to at least two of the three pressure sensors detecting pressure downstream of the choke above a threshold level.

5. The apparatus of claim 1, wherein the logic solver includes an electronic logic device and the pressure sensors include pressure transducers.

6. The apparatus of claim 1, wherein the logic solver includes a hydraulic logic solver.

7. The apparatus of claim 1, wherein the Christmas tree is a surface Christmas tree.

8. An apparatus comprising:

a distributed high-integrity pressure protection system including:

a plurality of pressure sensors of the distributed high-integrity pressure protection system, wherein the plurality of pressure sensors is connected to measure pressure downstream of a choke; and a plurality of valves of the distributed high-integrity pressure protection system, wherein the plurality of valves is connected to control flow upstream of the choke; and a controller of the distributed high-integrity pressure protection system, wherein the controller is configured to control operation of the plurality of valves upstream of the choke based on the pressure measured by the plurality of pressure sensors downstream of the choke.

9. The apparatus of claim 8, wherein the plurality of valves of the distributed high-integrity pressure protection system includes one or more valves of a Christmas tree.

10. The apparatus of claim 8, wherein each valve of the plurality of valves of the distributed high-integrity pressure protection system is a valve of a Christmas tree.

11. The apparatus of claim 8, wherein each valve of the plurality of valves of the distributed high-integrity pressure protection system is a valve of a subsea Christmas tree.

12. The apparatus of claim 8, comprising the choke.

13. The apparatus of claim 8, wherein the controller is an electronic logic device.

14. A method comprising:

coupling pressure sensors of a high-integrity pressure protection system to a fluid conduit downstream of a Christmas tree so as to allow monitoring of fluid conduit pressure downstream of the Christmas tree with the pressure sensors of the high-integrity pressure protection system;

coupling a logic solver of the high-integrity pressure protection system to the pressure sensors of the high-integrity pressure protection system; and incorporating valves of the Christmas tree as part of the high-integrity pressure protection system by coupling the valves to the logic solver of the high-integrity pressure protection system so as to allow the logic solver of the high-integrity pressure protection system to control operation of the valves based on the monitored fluid conduit pressure downstream of the Christmas tree.

15. The method of claim 14, comprising routing a produced fluid through the high-integrity pressure protection system.

16. The method of claim 15, comprising monitoring the fluid conduit pressure downstream of the Christmas tree with the pressure sensors of the high-integrity pressure protection system.

17. The method of claim 16, comprising:

detecting that the monitored fluid conduit pressure downstream of the Christmas tree has exceeded a threshold level; and automatically closing one or more of the valves of the Christmas tree in response to detecting that the monitored fluid conduit pressure downstream of the Christmas tree has exceeded the threshold level.

18. The method of claim 15, comprising routing the produced fluid through a choke positioned downstream of the valves of the Christmas tree incorporated as part of the high-integrity pressure protection system and positioned upstream of the pressure sensors of the high-integrity pressure protection system.

* * * * *